United States Patent [19]

Schilling

[11] 4,238,184

[45] Dec. 9, 1980

[54] FLAME DETECTION SYSTEM USING A VOLTAGE CLIPPER MEANS

[75] Inventor: Roger A. Schilling, West Saint Paul, Minn.

[73] Assignee: Honeywell Inc., Minneapolis, Minn.

[21] Appl. No.: 59,423

[22] Filed: Jul. 20, 1979

Related U.S. Application Data

[63] Continuation of Ser. No. 856,695, Dec. 2, 1977, abandoned.

[51] Int. Cl.[3] ..... F23Q 9/08

[52] U.S. Cl. ..... 431/59; 431/74; 431/78; 340/579

[58] Field of Search ..... 431/25, 45, 46, 71, 431/73, 74, 78; 340/579

[56] References Cited

U.S. PATENT DOCUMENTS

| | | | |
|---|---|---|---|
| 2,729,281 | 1/1957 | Lindberg et al. | 431/71 |
| 2,948,335 | 8/1960 | Hegwein . | |
| 3,265,114 | 8/1966 | Childree . | |
| 3,269,447 | 8/1966 | McCarthy et al. . | |
| 3,291,183 | 12/1966 | Fairley | 431/74 |
| 3,377,125 | 4/1968 | Zielinski | 431/74 |
| 3,554,680 | 1/1971 | Malavasi | 431/78 |
| 3,610,790 | 10/1971 | Lindberg | 431/78 |
| 3,614,280 | 10/1971 | Tamio | 431/78 |
| 3,619,097 | 11/1971 | Clay | 431/60 |
| 3,718,423 | 2/1973 | Matthews | 431/264 |
| 3,726,630 | 4/1973 | Potts | 431/78 |
| 3,975,136 | 8/1976 | Baysinger et al. | 431/74 |

*Primary Examiner*—Carroll B. Dority, Jr.
*Attorney, Agent, or Firm*—Alfred N. Feldman

[57] ABSTRACT

A fuel ignition system that uses a high voltage spark generator and a flame rectification detecting circuit is disclosed. The system utilizes a voltage clipping means in the form cf a neon tube to prevent the high voltage of the ignition system from interferring with the operation of the flame detection system even though both systems use a common spark gap.

4 Claims, 2 Drawing Figures

FLAME DETECTION SYSTEM USING A VOLTAGE CLIPPER MEANS

This is a continuation of application Ser. No. 856,695, filed Dec. 2, 1977 and now abandoned.

BACKGROUND OF THE INVENTION

In many fuel ignition systems, high voltage spark generators are used to ignite the fuel. This is particularly true in systems that utilize fuel oil and gas for various heating applications. In these systems, it is necessary to provide for a spark gap for ignition, and also provide some means of monitoring the existence of the flame. In most conventional systems this is accomplished by providing one pair of electrodes for the spark ignition source and the use of an entirely separate means for flame sensing. The flame sensing can be done by detecting the ultraviolet radiation from the flame, the visible light radiated from the flame, the infrared radiation from the flame, or by the conductivity of the flame itself. In many of the simpler systems, flame conductivity or flame rectification have been used as a means of sensing the presence of the flame.

In most prior systems that use spark ignition for lighting the fuel initially, a separate pair of electrodes are normally used if flame rectification or flame conductivity are used as a flame sensing means. An example of such an arrangement is disclosed in the U.S. Pat. No. 3,619,097 which utilizes a pair of electrodes connected to a relaxation type of silicon controlled oscillator that periodically discharges a capacitor across the pair of electrodes, and this system uses a further sensing electrode to sense the flame by rectification principles between the sensor and the burner structure itself. The use of two separate circuits adds unnecessarily to the expense and the complications of installing a system.

SUMMARY OF THE INVENTION

In the present invention, a single pair of spark gap electrodes are utilized for both spark ignition and for the flame rectification circuitry used to operate the flame detector. While this broad principle is not in and of itself new, the present invention is directed to the use of a clipping means connected across the high voltage output that generates the spark across the electrodes so that the current flowing in the high voltage circuitry is caused to be shunted by the clipping means and thereby kept out of the circuitry used for flame detection. In its simplest form, the voltage clipping means is a neon type gas tube which breaks over at a relatively low voltage compared to the spark generating voltage. The voltage at which the tube breaks over is substantially higher, however, than the voltage used in the flame detection circuit.

DESCRIPTION OF THE PREFERRED EMBODIMENT

Figure 1:
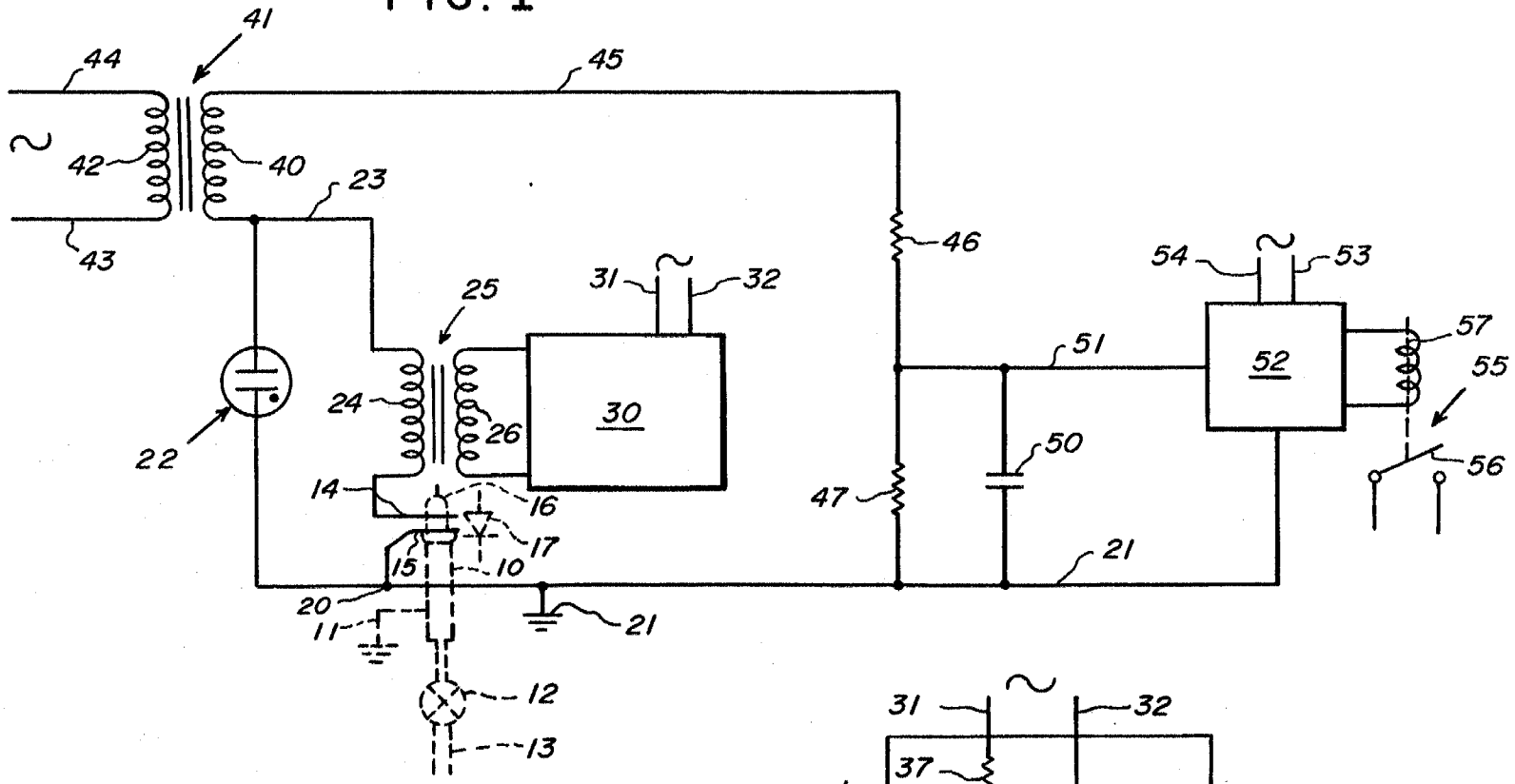
FIG. 1 is a schematic drawing of a spark generation and flame detection arrangement using the present invention.

The spark generation and flame detection arrangement disclosed in FIG. 1 has been shown as adapted to ignite fuel issuing from a burner 10, such as a pilot for a furnace. The burner 10 is grounded at 11 and is supplied through a valve 12 with fuel from a pipe 13. While the present disclosure references a fuel burner for a furnace, the particular type of burner is not material and the reference to the furnace type installation is merely a point of reference.

At the startup of the system, the valve 12 would be opened to allow fuel to issue from the burner 10 where it would pass over a pair of electrodes 14 and 15 which serve a dual function in the present device. The electrodes 14 and 15 form a spark gap as part of the spark generation or ignition system, and simultaneously provide a pair of electrodes for monitoring of a flame which has been indicated at 16. The flame 16, when the electrodes 14 and 15 are properly energized, can rectify an electrical current between the electrodes 14 and 15 and this has been represented by the diode equivalent 17.

The electrode 15 is connected at 20 to a ground 21 which is the same ground as ground 11 which is part of the burner 10. The ground 21 forms a common conductor for a larger portion of the circuitry to which is connected a voltage clipping means 22. The voltage clipping means 22 has been specifically shown as a gas filled tube and in a practical embodiment would be a neon breakdown type tube which characteristically has a breakdown potential of roughly 200 volts and will conduct electrical energy in a bidirectional fashion, in a well-known manner. The voltage clipping means 22 could be a number of other type devices, such as a solid state bidirectional voltage breakdown device that might be made up of a pair of back-to-back zener diodes. Since the neon tube is the most convenient, economical, and practical component now commercially available, the circuit has been shown specifically as using that type of element.

The voltage clipping means 22 is connected at conductor 23 to a transformer secondary winding 24 of a high voltage transformer generally disclosed at 25. The secondary winding 24 is in turn connected to the previously noted electrode 14. The transformer 25 has a primary winding 26 that is connected generally to the block 30 that is energized on conductors 31 and 32 by an alternating current voltage. The block 30, along with the transformer 25, forms a spark generator means for the disclosed arrangements, and the winding 24 provides the output means for the spark generator means. The voltage developed across the winding 24 is of a relatively high voltage value and will depend on the particular application. Normally the voltage output would be in the range of a number of thousands of volts and thereby would be high compared to the voltage breakdown characteristics of the voltage clipping means 22.

The spark generator means 30 could simply be a switch arrangement to supply power to a conventional high voltage transformer 25 or could be a more compact and sophisticated device in the form of a silicon controlled, capacitive discharge relaxation oscillator that is commonly used in fuel ignition in present day equipment. A very simple schematic of such a device is disclosed in FIG. 2.

Figure 2:
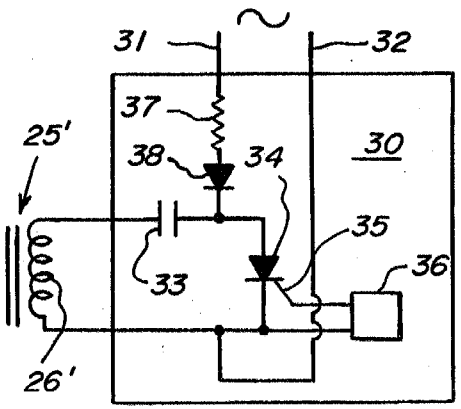
FIG. 2 is a representation of one type of silicon controlled rectifier relaxation oscillator that can be used as a high voltage generator.

In FIG. 2 the spark generator means 30 is disclosed as including an output transformer 25' having a primary winding 26' that is connected across a capacitor 33 and a silicon controlled rectifier 34. The silicon controlled rectifier 34 has a gate circuit 35 that is connected to a gating means 36. The power conductors 31 and 32 are again supplied so that energy is caused to flow through a resistor 37 and a diode 38 to charge the capacitor 33 with a desired charge. Upon the gating of the silicon controlled rectifier 34, the capacitor 33 is rapidly discharged through the winding 26' to generate a high voltage pulse in the transformer means 25'. The gating circuitry 36 is not material to the present invention and could be a free running type of gating arrangement or could be synchronized with other elements in the system. The disclosure of FIG. 2 has been shown as an example of a high voltage spark generating means that could be utilized with the present invention in place of a conventional high voltage transformer.

The circuitry that has been described to this point generally provides for the spark generation portion of the present arrangement. Before its mode of operation is described, the balance of the circuitry which is the flame detection arrangement will be described. The voltage clipping means 22 and conductor 23 are connected to a secondary winding 40 of a transformer 41 which has a primary winding 42 that is energized between conductors 43 and 44 from a conventional source of alternating current. The voltage that is provided across the winding 40 is normally in the range of 24 to 120 volts. This is a voltage that is low compared to the voltage in the spark generator means, and also is low compared to the breakdown voltage of the voltage clipping means 22. This differential in voltage is material to the present invention and its importance will be brought out in connection with the operation of the system.

The transformer secondary winding 40 is further connected by conductor 45 through a resistor 46 and a further resistor 47 to the ground 21. The resistor 47 is paralleled by a capacitor 50, and the parallel combination of the resistor 47 and the capacitor 50 is connected by conductors 51 and the ground 21 to a flame detection means generally disclosed at 52. The flame detection means 52 is energized by conductors 53 and 54 from a conventional source of alternating current. The various sources of alternating current that have been shown could all be common, but have been shown individually for convenience in the present disclosure. The flame detection means 52 provides a switching output generally disclosed at 55 as including a normally open switch 56 operated by a relay coil 57. The output switching means 55 from the flame detection means 52 could be a solid state switch and in no way should be considered as limited to the disclosed relay. When the switch 56 is closed, a circuit is completed to a valve for a burner (not shown) which is the main burner that is ignited from the pilot burner 10. The switching would normally be either by the disclosed relay or by a solid state switch to control a valve in the main burner line so that the main burner could be ignited whenever the flame detection means 52 was energized in response to the flame 16 being present at the pilot burner 10. The manner in which this is accomplished will now be described.

OPERATION OF FIG. 1

It is initially assumed that power is supplied to the conductors 31, 32, 43, 44, 53 and 54 to energize the system. The application of power to the spark generator means 30 causes a high voltage to appear at the output of the winding 24. This high voltage is sufficient to easily break down the voltage clipping means 22 so that the voltage in reality appears across the gap formed by the electrodes 14 and 15. The voltage is sufficiently high to break down this gap and causes a spark to jump between the electrodes 14 and 15. At this same time the valve 12 has been opened to admit fuel to the burner 10 and the flame 16 is initiated. Since the voltage clipping means 22 breaks down at a voltage of about 200 volts, the maximum voltage that can appear during the build up of the high voltage at the transformer secondary 24 that would be coupled into the transformer winding 40 and the resistors 46 and 47 is at or below the 200 volt level. In effect, the voltage clipping means 22 keeps the relatively high spark ignition voltage limited to the ignition circuit which has just been described.

As soon as the flame 16 appears across the electrodes 14 and 15, a rectifier action 17 will occur as long as a voltage is applied across the electrodes 14 and 15. This voltage is applied by the transformer secondary 40 in series with the winding 24 to ground 21 and through the resistors 46 and 47 along with the conductor 45. It is thus evident that as soon as the flame 16 appears that a rectified current is provided in the circuit just described. This rectified current provides a charge for the capacitor 50 which is then applied to the flame detection means 52 causing the flame detection means 52 to energize the coil 57 and close the switch 56. This is connected to the main gas valve or fuel valve of a burner so that fuel would be admitted to be ignited by the flame 16.

In most normal installations, the flame detection circuit means 52 would include a switching circuit to turn "off" the spark generating means 30 once a flame had been established. If it is assumed that this is the case here, the spark generating means 30 would be turned "off" and the only voltage appearing across the electrodes 14 and 15 would be the relatively low voltage supplied to the winding 40 through the series winding 24 to continuously be rectified by the flame 16 to keep a charge on the capacitor 50. This keeps the flame detection circuit means 52 energized and keeps the system in operation. It is obvious that if the flame is lost at any time, the rectification effect 17 is lost and the capacitor 50 is immediately depleted of its charge thereby allowing the flame detection means 52 to immediately deenergize the coil 57 thereby dropping out the main burner.

The present invention envisions the simultaneous application of a relatively high voltage for spark generation and a relatively low voltage for flame detection across a single spark gap. This is accomplished by the use of a voltage clipping means which in effect restricts the high voltage in the system only to the circuitry of the spark generation means, and prevents the voltage from building up in the flame detection circuit means thereby protecting it from the exceedingly high voltages necessary for spark ignition of fuels. This allows for the compatible interconnection of both circuits across a single spark gap. It is obvious that a number of circuit modifications would be possible to accomplish this end, and only the simplest and most direct circuit configuration has been shown. For these reasons, the applicant wishes to be limited in the scope of his invention solely by the appended claims.

The embodiments of the invention in which an exclusive property or right is claimed are defined as follows:

1. A spark generation and flame detection arrangement, including; spark generator means including a transformer secondary output winding having an output voltage which is high enough to produce an ignition spark across a spark gap and adapted to ignite a fuel;

flame detector means including a transformer secondary winding impressing a flame detection voltage across said spark gap with said spark generator transformer secondary winding in series circuit with said detector transformer secondary winding; said flame detection voltage providing a current in said flame detection means when flame is present across said spark gap; and voltage clipping means connected across said spark gap and said spark generator transformer secondary winding; said voltage clipping means having a clipping voltage that is low compared to said spark generator output voltage, and that is high compared to said flame detection voltage; said voltage clipping means acting to conduct said spark generator means output voltage to prevent said spark generator output voltage from adversely affecting said flame detection means.

2. A spark generation and flame detection arrangement as described in claim 1 wherein said voltage clipping means is a bidirectional voltage breakdown device.

3. A spark generation and flame detection arrangement as described in claim 2 wherein said voltage breakdown device is a gas tube, and said flame detection means includes flame rectification responsive circuit means.

4. A spark generation and flame detection arrangement as described in claim 3 wherein said spark generating means includes silicon controlled rectifier relaxation oscillator means to generate said output voltage that is adapted to ignite said fuel.

* * * * *